US007262751B2

(12) United States Patent
Chung et al.

(10) Patent No.: US 7,262,751 B2
(45) Date of Patent: Aug. 28, 2007

(54) DIGITAL DRIVING METHOD OF ORGANIC ELECTROLUMINESCENT DISPLAY DEVICE

(75) Inventors: Hoon-Ju Chung, Gyeonggido (KR); Jae-Ho Sim, Daegu (KR)

(73) Assignee: LG. Philips LCD Co., Ltd., Seoul (KR)

( * ) Notice: Subject to any disclaimer, the term of this patent is extended or adjusted under 35 U.S.C. 154(b) by 95 days.

(21) Appl. No.: 11/107,312

(22) Filed: Apr. 15, 2005

(65) Prior Publication Data

US 2005/0243586 A1 Nov. 3, 2005

(30) Foreign Application Priority Data

Apr. 16, 2004 (KR) ..... 10-2004-0026099

(51) Int. Cl.
*G09G 3/30* (2006.01)
*G09G 3/34* (2006.01)
*G09G 3/10* (2006.01)

(52) U.S. Cl. ..... 345/76; 345/82; 315/169.3

(58) Field of Classification Search ..... 345/76–84; 315/169.3

See application file for complete search history.

(56) References Cited

U.S. PATENT DOCUMENTS

| | | | | |
|---|---|---|---|---|
| 6,686,699 | B2 * | 2/2004 | Yumoto | 315/169.3 |
| 6,876,345 | B2 * | 4/2005 | Akimoto et al. | 345/76 |
| 7,027,026 | B2 * | 4/2006 | Tsutsui | 345/98 |
| 2003/0197663 | A1 * | 10/2003 | Lee et al. | 345/76 |
| 2004/0095299 | A1 * | 5/2004 | Matsumoto | 345/76 |
| 2004/0217925 | A1 * | 11/2004 | Chung et al. | 345/76 |

FOREIGN PATENT DOCUMENTS

| | | |
|---|---|---|
| KR | 2002-66190 | 8/2002 |
| KR | 2003-07135 | 1/2003 |

OTHER PUBLICATIONS

Mayumi Mizukami, Kazutaka Inukai, Hirokazu Yamagata, Toshimitsu Konuma, Takeshe Nishi, Jun Koyama, Shumpei Yamazaki and Tetsuo Tsutsui, *36.1: 6-Bit Digital VGA OLED*, pp. 912-915, SID Digest, 2000.

Kazutaka Inukai, Hajime Kimura, Mayumi Mizukami, Junya Maruyama, Satoshi Murakami, Jun Koyama, Toshimitsu Konuma and Shumpei Yamazaki, *36.4L: Late-News Paper: 4.0-in. TFT-OLED Displays and a Novel Digital Driving Method*.

Office Action dated May 29, 2006, for corresponding Korean Office Action 10-2004-0026099.

* cited by examiner

*Primary Examiner*—Richard Hjerpe
*Assistant Examiner*—M. Fatahiyar
(74) *Attorney, Agent, or Firm*—Brinks Hofer Gilson & Lione

(57) ABSTRACT

An organic electroluminescent display device includes a scan line, a data line, a voltage supply line, a switching transistor connected to the scan and data lines, a driving transistor connected to the switching transistor and the voltage supply line, a storage capacitor connected between the switching transistor and the voltage supply line, and an organic light-emitting diode connected to the driving transistor and ground. A black display voltage applied to the data line is supplied to the driving transistor when a first gate ON signal is applied to the scan line. A video data voltage applied to the data line is supplied to the driving transistor when a second gate ON signal is applied to the scan line. The voltages are applied at least once each frame.

17 Claims, 11 Drawing Sheets

DIGITAL DRIVING METHOD OF ORGANIC ELECTROLUMINESCENT DISPLAY DEVICE

This application claims the benefit of Korean Patent Application No. 2004-0026099, filed on Apr. 16, 2004, which is hereby incorporated by reference as if fully set forth herein.

FIELD OF THE INVENTION

The present invention relates to an organic electroluminescent display device, and more particularly, to an organic electroluminescent display device having a high resolution and a high aperture ratio and a digital driving method of the same.

DISCUSSION OF THE RELATED ART

A liquid crystal display (LCD) device has been widely used for its numerous advantages including light weight, thinness, and low power consumption. However, since the LCD device is not self-luminescent, the LCD device requires an additional light source such as a backlight unit.

On the other hand, an organic electroluminescent display device emits light by injecting electrons from a cathode electrode and holes from an anode electrode into an emissive layer, combining the electrons and the holes to generate an exciton, and by the exciton transitioning from an excited state to a ground state. Since the organic electroluminescent display device does not require an additional light source due to its self-luminescence property, the organic electroluminescent display device has a small size and is light weight, as compared to a liquid crystal display (LCD) device. The organic electroluminescent display device also has low power consumption, high brightness, and a short response time. In addition, the organic electroluminescent display device can have reduced manufacturing costs because of its simple manufacturing processes.

FIG. 1 is an equivalent circuit for a pixel of an organic electroluminescent display (OELD) device according to the related art, and FIG. 1 shows a pixel of a two-thin film transistor structure.

As shown in FIG. 1, scan lines (S1, S2, S3, . . . , and Sm: m is a natural number) and data lines (D1, D2, . . . , and Dn: n is a natural number) are arranged in a matrix form to define pixel regions. In each pixel region, a switching thin film transistor (TFT) N1, a storage capacitor C1, a driving thin film transistor (TFT) P1, and an organic light-emitting diode OLED are formed. The switching TFT Ni is an n-type transistor, and the driving TFT P1 is a p-type transitor.

A gate electrode of the switching TFT N1 is connected to the scan line S1, and a source electrode of the switching TFT N1 is connected to the data line D1. One electrode of the storage capacitor C1 is connected to a drain electrode of the switching TFT N1, and the other electrode of the storage capacitor C1 is connected to a power supply line V. A gate electrode of the driving TFT P1 is connected to the drain electrode of the switching TFT N1 and the one electrode of the storage capacitor C1, a source electrode of the driving TFT P1 is connected to the power supply line V, and a drain electrode of the driving TFT P1 is connected to an anode electrode of the organic light-emitting diode OLED.

The organic electroluminescent display device having the above structure can be driven as follows.

The switching TFT N1 turns ON by a positive selecting voltage supplied from the scan line S1, and the storage capacitor C1 is charged due to a data voltage supplied from the data line D1. Intensity of a current flowing through the driving TFT P1 depends on the data voltage stored in the storage capacitor C1, and the organic light-emitting diode OLED emits light according to the intensity of the current.

According to the above-mentioned method, the scan lines S1, S2, . . . , and Sm are sequentially enabled, and thus data signals are applied to respective elements connected to the corresponding scan line through the data lines D1, D2, . . . , and Dn.

FIG. 2 is a graph showing variations of current flowing through an organic light-emitting diode in a related art organic electroluminescent display device having the structure of FIG. 1 when a data voltage of a data line, that is, a voltage applied to a gate electrode of a driving TFT, is changed.

As shown in FIG. 2, current $I_{OEL}$ through an organic light-emitting diode is directly modulated with an analog voltage $V_S$ applied to the gate electrode of the driving TFT. However, the voltage on the gate electrode of the driving TFT varies due to the variation of a threshold voltage. A change rate of the current through the organic light-emitting diode against the voltage on the gate electrode of the driving TFT varies because of the mobility variation of the driving TFT. Accordingly, each pixel has different emitting characteristics, even if the same voltage is applied to the gate electrode of each driving TFT, and it is difficult to determine an accurate gray scale level in each pixel.

To solve the above problem, several digital driving methods have been developed. In the digital driving methods, a gray scale level is achieved by controlling lighting periods of each pixel.

FIG. 3 is an equivalent circuit for a pixel of an organic electroluminescent display device using a display period separated (DPS) driving method according to the related art. FIG. 4 is a timing diagram of a voltage applied to a cathode electrode during a frame period in an organic light-emitting diode of FIG. 3.

The pixel of FIG. 3 has the same structure as that of FIG. 1. The pixel includes two transistors, that is, a switching TFT of n-type and a driving TFT of p-type, and the data line of FIG. 1 is referred to as a signal line in FIG. 3.

In FIG. 4, one frame period is divided into sub-frame periods. For example, in 6-bit (64 gray scale), one frame consists of six sub-frame periods. Each sub-frame period includes an addressing period TA and one of lighting periods TL1, TL2, TL3, TL4, TL5, and TL6. In the addressing period TA, a data signal from the signal line is applied to the gate electrode of the driving TFT and stored in the storage capacitor. At this addressing period, a high voltage Vch is applied to a cathode electrode of the organic light-emitting diode OLED of FIG. 3, and the high voltage Vch equals a high voltage $V_{SH}$ of FIG. 2 applied to the signal line and a voltage in a supply line of FIG. 3. At this time, the organic light-emitting diode OLED does not emit light because the high voltage Vch is applied to the cathode electrode. That is, no current flows through the driving TFT, even if a low voltage is applied to the gate electrode of the driving TFT (or the storage capacitor).

Next, in a lighting period, a low voltage Vcl is applied to the cathode electrode of the organic light-emitting diode OLED. A low voltage $V_{SL}$ of FIG. 2 is supplied to the gate electrode of the driving TFT (or the storage capacitor), whereby the driving TFT turns ON, and the organic light-emitting diode OLED emits light. Here, if the low voltage Vcl applied to the cathode is higher than the low voltage $V_{SL}$ applied to the signal line, the next sub-frame period follows.

A length of each lighting period is controlled by an additional digital driving system of FIG. 5.

FIG. 5 is a schematic view of an organic electroluminescent display device using a display period separated (DPS) driving method according to the related art. In FIG. 5, pixels including the structure of FIG. 3 are formed on a glass substrate, and a data driver circuit and a gate driver circuit supply signals to the pixels. In the DPS driving method, to alternately apply the high voltage and the low voltage to the cathode electrode, an external voltage source is connected to all cathode electrodes.

In the digital driving method such as the DPS driving method, even if the characteristics of the driving TFT vary, image uniformity is attained since currents through all pixels are expected the same. Additionally, some variations of the voltage applied to the gate electrode of each driving TFT are allowed because the current through each organic light-emitting diode hardly changes when the voltage on the gate electrode of the driving TFT varies a little.

However, in the organic electroluminescent display device using the DPS driving method, the addressing period increases as the size and resolution of the organic electroluminescent display device increases, and thus the lighting period decreases. Moreover, an additional operation for swinging the voltages applied to the cathode electrode of the organic light-emitting diode OLED is required.

A simultaneous erasing scan (SES) driving method has been proposed as another digital driving method.

FIG. 6 is an equivalent circuit for a pixel of an organic electroluminescent display device using an SES driving method according to the related art. FIG. 7 is a timing diagram illustrating operation of an organic electroluminescent display device using an SES driving method according to the related art during a frame period. In FIG. 7, a vertical axis represents a row of pixels selected by a scan driver, and a horizontal axis represents time passage. To express 6-bit (64 gray scale), a frame period is divided into six sub-frames. FIG. 8 is a schematic circuit diagram of an organic electroluminescent display device using an SES driving method according to the related art.

As shown in the figures, a pixel area includes pixels, video data lines, writing scan lines, and erasing scan lines. In FIG. 6, each pixel has three transistors. The three transistors consists of a first switching TFT Sw1 for writing data, a second switching TFT Sw2 for an erasing data, and a driving TFT Dr for driving an organic light-emitting diode OLED.

A cathode electrode in each pixel is shared with all of the other ones. An OLED voltage supply line, i.e., a power supply line, is used in common in the same way to display a monochrome image.

A data driver D-Drv. provides data signals to the video data lines, a writing scan driver PS-Drv. controls writing switch signals of data, and an erasing scan driver ES-Drv. controls erasing switch signals of data. Only the data driver D-Drv. and the writing scan driver PS-Drv. are engaged to write video data to each pixel. The erasing scan driver ES-Drv. works on erasing the pixel data, independent of the data driver D-Drv. and the writing scan driver PS-Drv., and the erasing scan driver ES-Drv. works at different timing from that of the writing scan driver PS-Drv.

In an SES driving method, each sub-frame SF1, SF2, SF3, SF4, SF5, and SF6 has a display period including L1 or TL5, and first, second and third sub-frames SF1, SF2, and SF3 has a non-display period including TU1.

In FIG. 7, the display period and the non-display period are seen in a frame period and are set apart from each other by operation of the erasing scan driver ES-Drv. A voltage applied to a cathode electrode is not changed to turn the display period to the non-display period or vice versa. In addition, because the non-display period is not necessary to all sub-frames SF1, SF2, SF3, SF4, SF5 and SF6, some of the sub-frames SF1, SF2, SF3, SF4, SF5 and SF6 do not include the non-display period.

A right-falling line at the beginning of the display period means row section scan by the writing scan driver PS-Drv. for writing video data. Pixels written low (bright signal) light up and express bright on the spot. Meaning of a right-falling line at the end of the display period depends on what kind of period follows just after that. In one occasion, as in the case of the first sub-frame SF1, for example, successive period is a non-display period TU1 between next sub-frame and display period. In this occasion, the right-falling line at the end of the display period represents a row selection scan for initializing the video data into high by the erasing scan driver ES-Drv. to erase an image of the sub-frame. On the contrary, in the other occasion that successive period is a display period in the absence of a non-display period between next sub-frame and display period, as in the case of the display period TL5 for example, the line represents a row selection scan by the writing scan driver PS-Drv. for writing the video data corresponding to the next sub-frame. Therefore, an erasing scan is not executed in the fifth frame SF5.

As mentioned above, in the SES driving method, it is possible to turn the display period to the non-display period or vice versa without changing voltage of the cathode. Additionally, the SES driving method is suited for a high-resolution or color organic electroluminescent display device.

However, because the organic electroluminescent display device using the SES driving method has three transistors in a pixel, an aperture ratio of the organic electroluminescent display device decreases.

SUMMARY OF THE INVENTION

A digital driving method of an organic electroluminescent display device is presented in which an aperture ratio of the device is maximized and a digital operation is effectively carried out.

In one aspect, an organic electroluminescent display device comprises a scan line, a data line, a first voltage supply line, a switching thin film transistor connected to the scan and data lines, a driving thin film transistor connected to the switching thin film transistor and the first voltage supply line, a storage capacitor connected between the switching thin film transistor and the first voltage supply line, and an organic light-emitting diode OELD connected to the driving thin film transistor and a second voltage supply line. A method of driving the OELD comprises: a) applying a black display voltage to the data line; b) applying a first gate ON signal to the scan line to supply the black display voltage to the driving thin film transistor c) applying a video data voltage to the data line; and d) applying a second gate ON signal to the scan line to supply the video data voltage to the driving thin film transistor. The steps a), b), c) and d) are performed at least once each frame.

In another embodiment, the display device comprises a scan line, a data line, a first voltage supply line, a switching thin film transistor connected to the scan and data lines, a driving thin film transistor connected to the switching thin film transistor and the first voltage supply line, and a light emitter connected to the driving thin film transistor and a second voltage supply line. The method comprises: limiting the transistors contained in each pixel of the display device to the driving thin film transistor and the switching thin film transistor; and turning the light emitter on and off without altering a voltage applied to a cathode electrode of the light emitter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate an embodiment of the present invention and together with the description serve to explain the principles of that invention.

DETAILED DESCRIPTION OF THE ILLUSTRATED EMBODIMENTS

Reference will now be made in detail to an illustrated embodiment of the present invention, examples of which are shown in the accompanying drawings.

Figure 1:
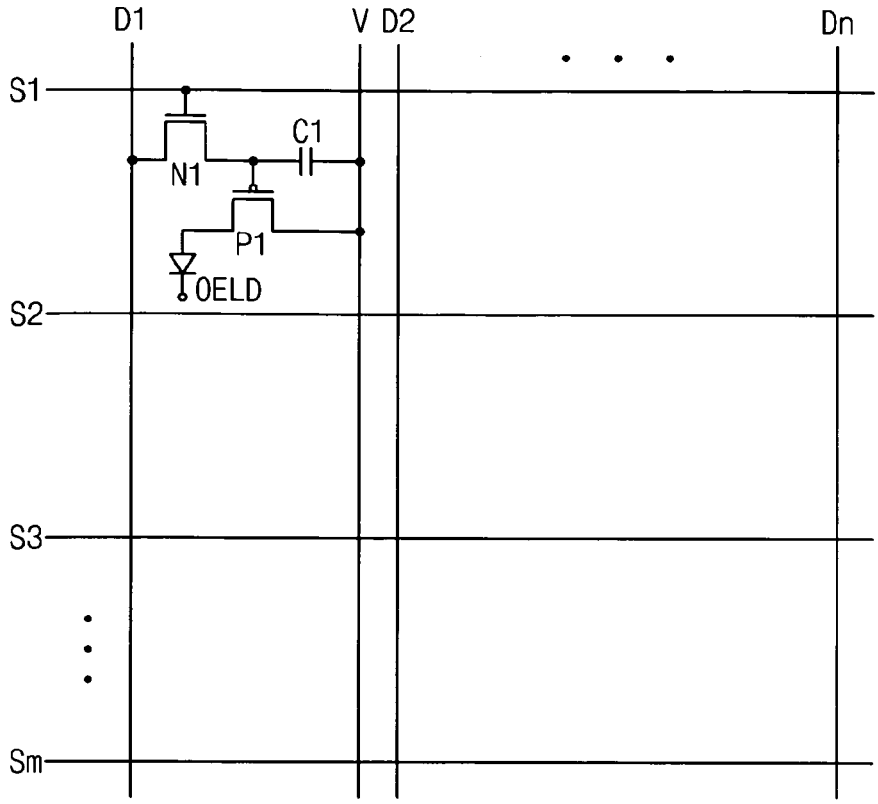
FIG. 1 (RELATED ART)
FIG. 1 is an equivalent circuit for a pixel of an organic electroluminescent display (OELD) device according to the related art.
Figure 2:
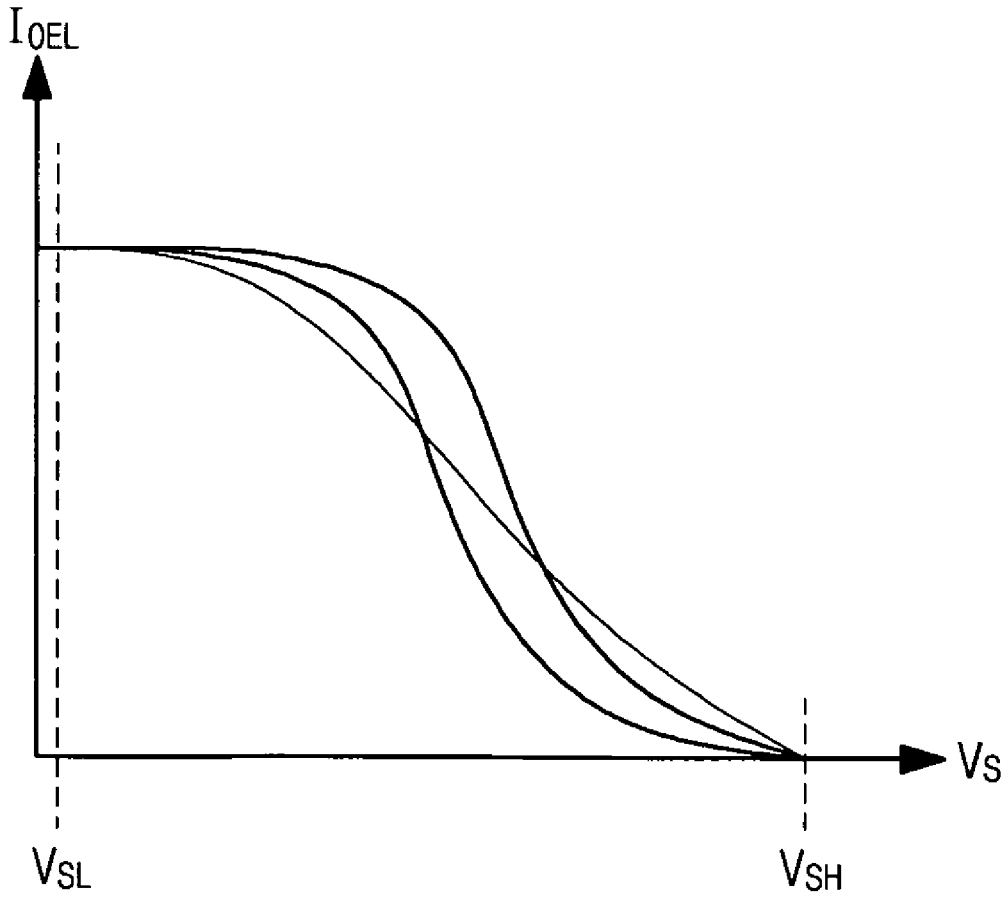
FIG. 2 (RELATED ART)
FIG. 2 is a graph showing variations of current flowing through an organic light-emitting diode in a related art organic electroluminescent display device having the structure of FIG. 1 when a data voltage of a data line is changed.
Figure 3:
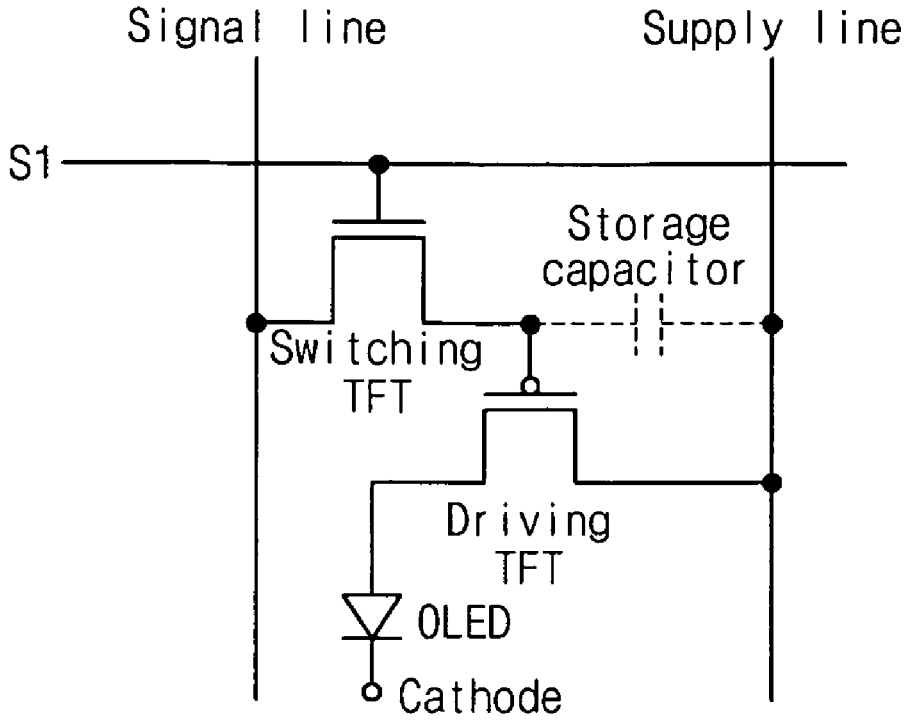
FIG. 3 (RELATED ART)
FIG. 3 is an equivalent circuit for a pixel of an organic electroluminescent display device using a display period separated (DPS) driving method according to the related art.
Figure 4:
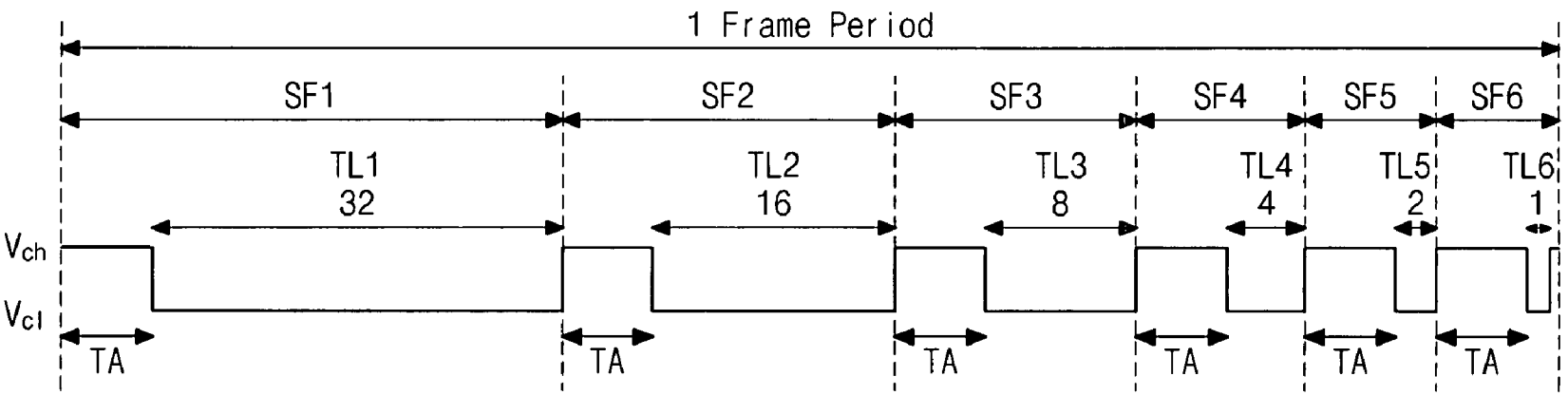
FIG. 4 (RELATED ART)
FIG. 4 is a timing diagram of a voltage applied to a cathode electrode during a frame period in an organic light-emitting diode of FIG. 3.
Figure 5:
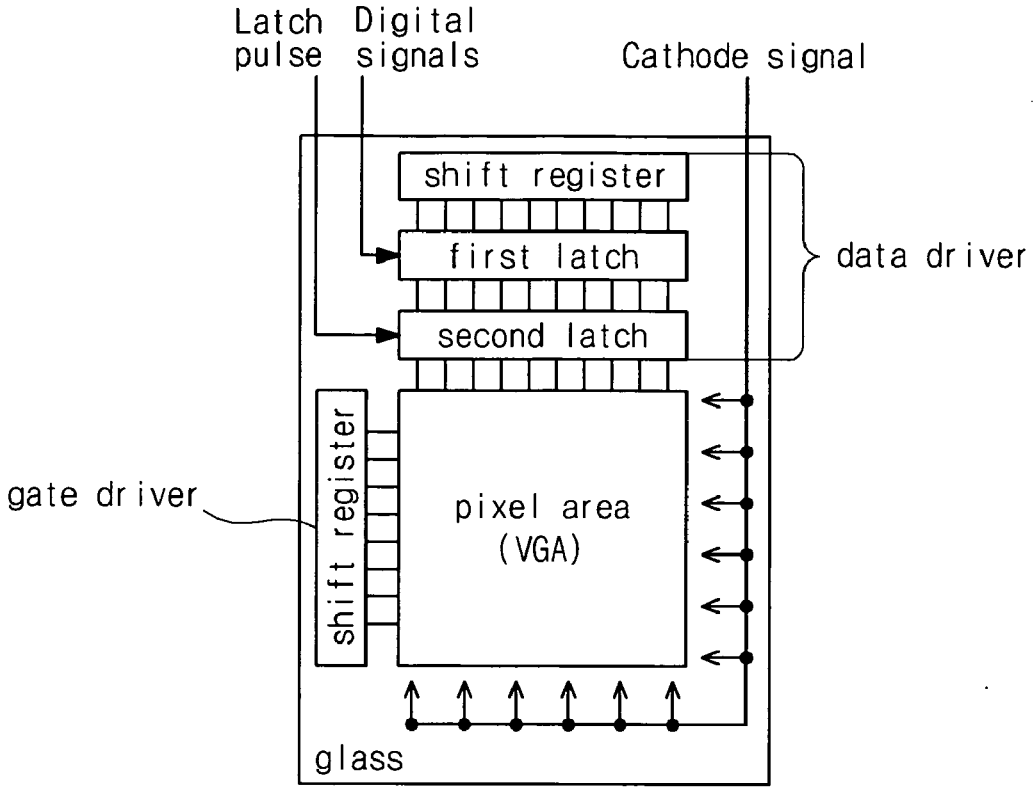
FIG. 5 (RELATED ART)
FIG. 5 is a schematic view of an organic electroluminescent display device using a display period separated (DPS) driving method according to the related art.
Figure 6:
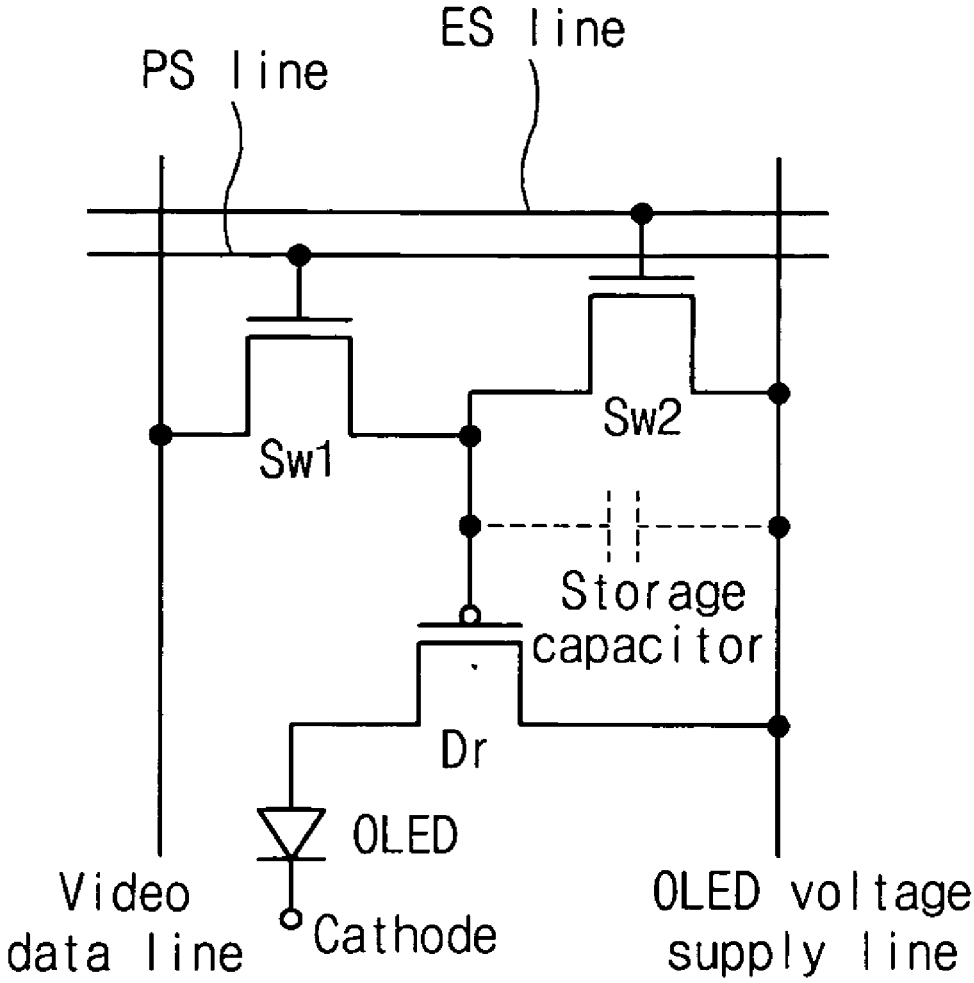
FIG. 6 (RELATED ART)
FIG. 6 is an equivalent circuit for a pixel of an organic electroluminescent display device using an SES driving method according to the related art.
Figure 7:
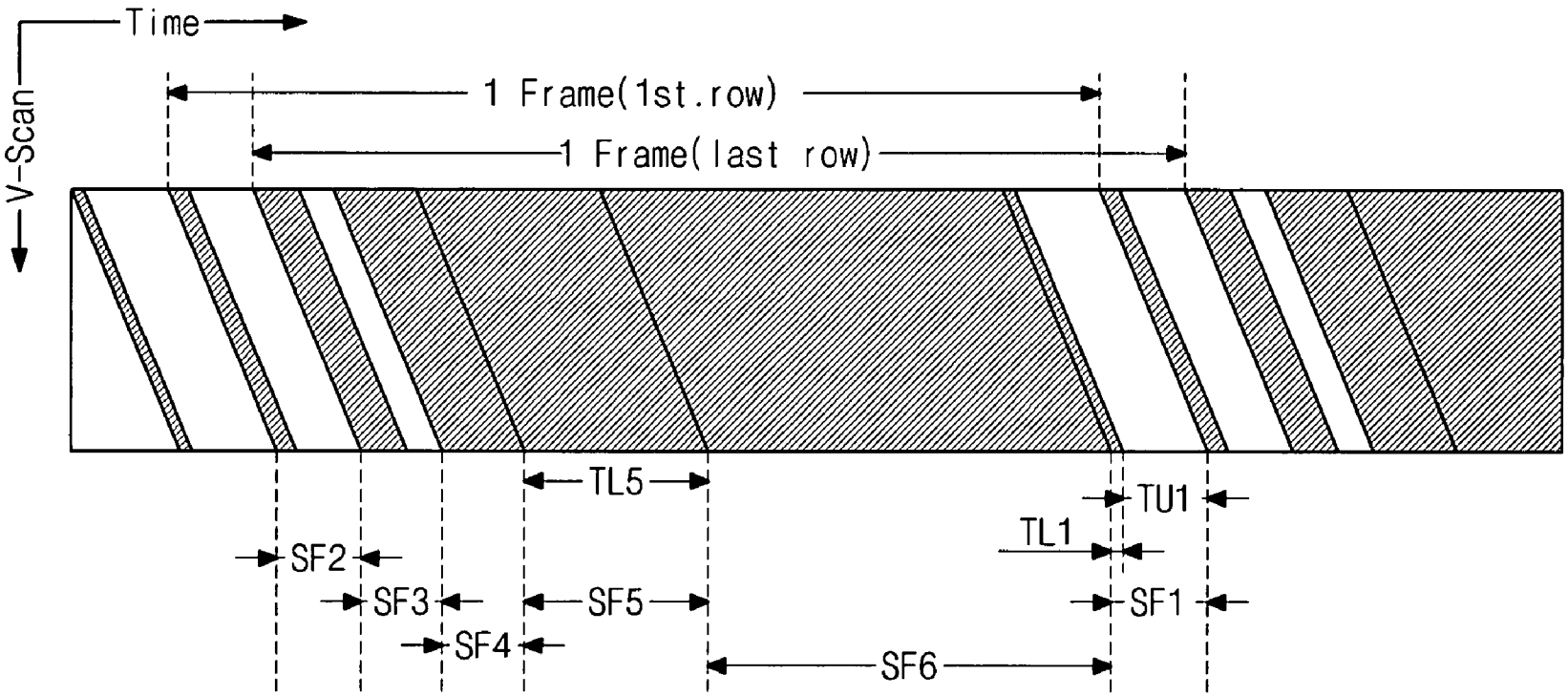
FIG. 7 (RELATED ART)
FIG. 7 is a timing diagram illustrating operation of an organic electroluminescent display device using an SES driving method according to the related art during a frame period.
Figure 8:
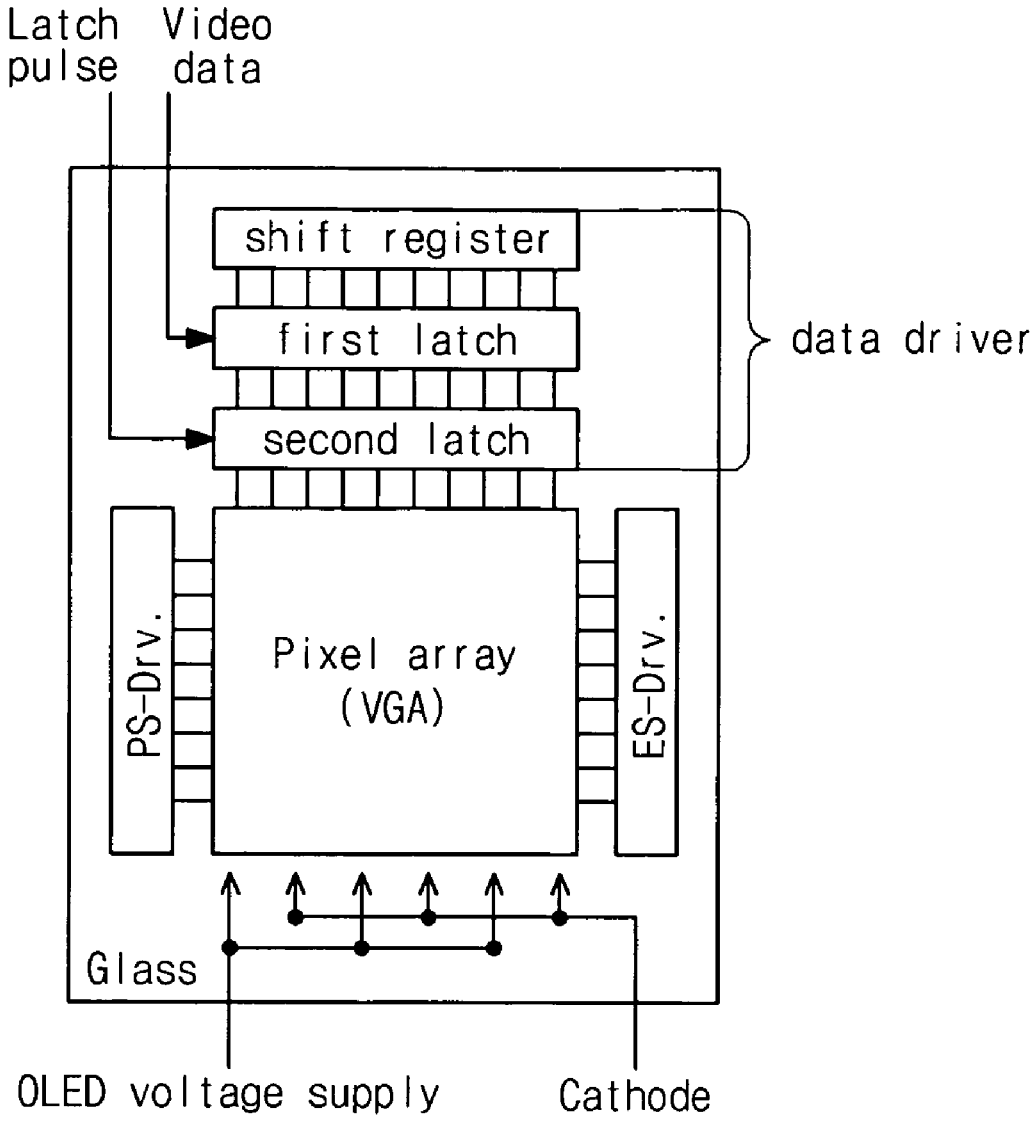
FIG. 8 (RELATED ART)
FIG. 8 is a schematic circuit diagram of an organic electroluminescent display device using an SES driving method according to the related art.
Figure 9:
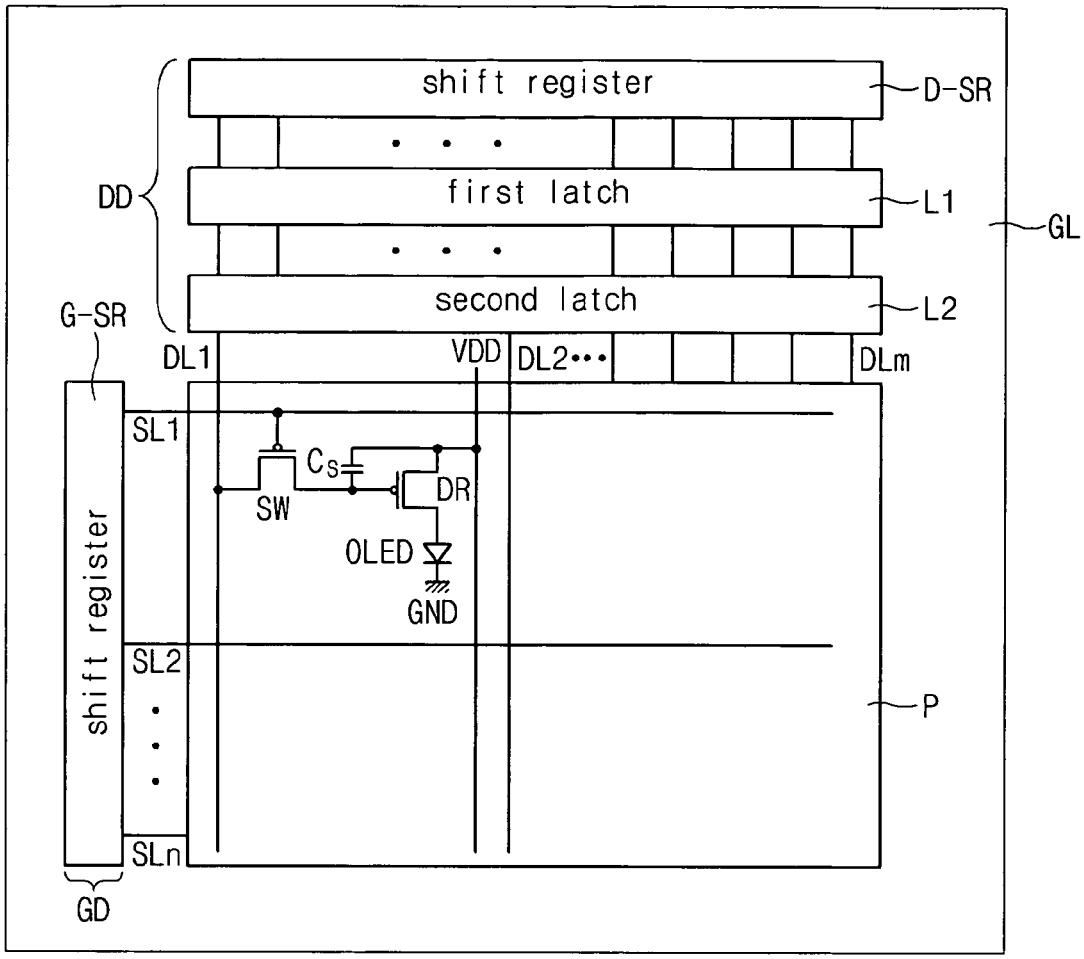
FIG. 9 is a view illustrating a schematic structure of an organic electroluminescent display device according to the present invention.

FIG. 9 illustrates a schematic structure of an organic electroluminescent display device according to the present invention.

In FIG. 9, an organic electroluminescent display device includes a pixel array P, a data driving unit DD and a gate driving unit GD formed on a glass substrate GL.

In the pixel array P, data lines DL1, DL2, . . . , and DLm (m is a natural number) and scan lines SL1, SL2, . . . , and SLn (n is a natural number) are arranged in a matrix form to define pixel regions. The data driving unit DD outputs video data signals to each of the data lines DL1, DL2, . . . , and DLm, and the gate driving unit GD outputs gate signals to each of the scan lines SL1, SL2, . . . , and SLn.

Each of the pixel regions includes a switching thin film transistor (TFT) SW, a driving thin film transistor (TFT) DR, a storage capacitor Cs, and an organic light-emitting diode OLED. The switching thin film transistor SW is connected to the data line and the scan line. The driving thin film transistor DR is connected to the switching thin film transistor SW and a power supply line VDD, and the driving thin film transistor DR is driven according to outputs of the switching thin film transistor SW. The storage capacitor Cs is connected to a drain electrode of the switching thin film transistor SW and the power supply line VDD. An anode electrode of the organic light-emitting diode OLED is connected to a drain electrode of the driving thin film transistor DR, and a cathode electrode of the organic light-emitting diode OLED is connected to a ground GND. The switching thin film transistor SW and the driving thin film transistor DR are a p-type.

The data driving unit DD includes a data shift register D-SR, a first latch circuit L1, and a second latch circuit L2. The shift register D-SR sequentially shifts and outputs signals according to inputted horizontal scan clock signals. The first latch circuit L1 stores digital data according to the output signals of the shift register D-SR. The second latch circuit L2 receives the digital data of the first latch circuit L1 and outputs digital video data according to latch signals.

The gate driving unit GD sequentially outputs gate signals to the scan lines SL1, SL2, . . . , SLn according to inputted vertical scan clock signals.

Since the organic electroluminescent display device of the present invention has two transistors in a pixel, the organic electroluminescent display device, which may have a high resolution, may have a high aperture ratio due to a simple structure.

Figure 10:
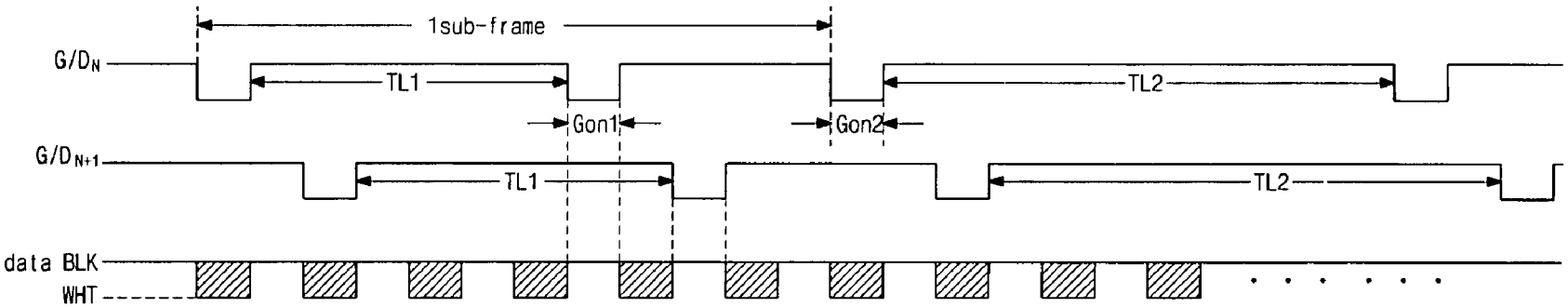
FIG. 10 is a timing diagram showing gate signals of an Nth gate line (N is a natural number) and an (N+1)th gate line and a data signal in an organic electroluminescent display device according to the present invention.
Figure 11:
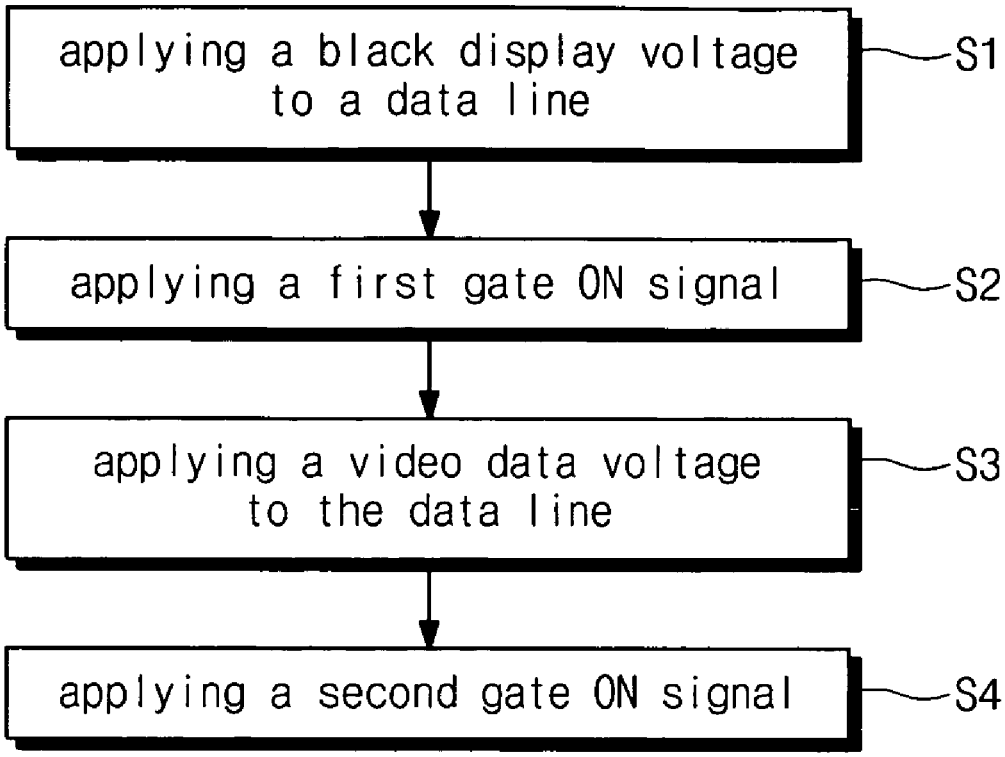
FIG. 11 is a flow chart illustrating a driving method of an organic electroluminescent display device according to the present invention.

FIG. 10 is a timing diagram showing gate signals of an Nth gate line (N is a natural number) and an (N+1)th gate line and a data signal in an organic electroluminescent display device according to the present invention. FIG. 11 is a flow chart illustrating a driving method of an organic electroluminescent display device according to the present invention.

In FIG. 10, a frame is divided into several sub-frames. Each sub-frame includes a lighting period, that is, a display period, and a non-display period. Lighting periods TL1, TL2, etc. are disposed in one frame dependent on gate signals supplied to the scan lines. Two gate ON signals Gon1 and Gon2 are applied before each display period starts.

A driving method of an organic electroluminescent display device according to the present invention will be explained from a first display period TL1 to a second display period TL2.

At step S1, to remove a first video data inputted during the first display period TL1, a black display voltage (i.e., a high voltage) BLK is applied to a data line.

At step S2, a first gate ON signal Gon1 is applied to a scan line while the black display voltage BLK is applied to the data line. As a result, the switching TFT SW is turned ON, and the black display voltage is provided to a gate of the driving TFT DR through the switching TFT SW, thereby the driving TFT DR is turned OFF. Therefore, the first video data is removed, and the organic light-emitting diode OLED does not emit light to thereby display a black image.

Next, at step S3, a second video data (that is, a low voltage) WHT is applied to the data line.

At step S4, a second gate ON signal Gon2 is applied to the scan line while the second video data WHT is applied to the data line. Accordingly, the second video data is supplied to the gate electrode of the driving TFT DR through the switching TFT SW, and the driving TFT DR turns ON. Thus, the organic light-emitting diode OLED emits light during the second display period TL2 to display an image corresponding to the second video data.

The steps ST1 to ST4 are performed at least once each a frame. The input time of the video data increases at the rate of $2^A$, which is proportional to the increase in the number of digital bits. Here, "A" is a positive integer including zero and is the number of repeated times in a frame.

As mentioned above, in the present invention, a digital operation such as an SES driving method can be achieved without swinging signals on the cathode electrode of the organic light-emitting diode OELD.

It will be apparent to those skilled in the art that various modifications and variation can be made in an organic electroluminescent display device of the present invention without departing from the spirit or scope of the invention. Thus, it is intended that the present invention cover the modifications and variations of this invention provided they come within the scope of the appended claims and their equivalents.

What is claimed is:

1. A driving method for an organic electroluminescent display device, the organic electroluminescent display device comprising a scan line, a data line, a first voltage supply line, a switching thin film transistor connected to the scan and data lines, a driving thin film transistor connected to the switching thin film transistor and the first voltage supply line, a storage capacitor connected between the switching thin film transistor and the first voltage supply line, and an organic light-emitting diode connected to the driving thin film transistor and a second voltage supply line, the method comprising:

a) applying a black display voltage to the data line;

b) applying a first gate ON signal to the scan line to supply the black display voltage to the driving thin film transistor;

c) applying a video data voltage to the data line; and d) applying a second gate ON signal to the scan line to supply the video data voltage to the driving thin film transistor.

2. The method claim 1, wherein a), b), c) and d) are performed at least once each frame.

3. The method of claim 2, wherein an input time of the video data voltage increases at a rate of $2^A$, where A is a positive integer including zero and is the number of times a), b), c) and d) are repeated in a particular frame.

4. The method of claim 1, wherein the switching thin film transistor and the driving thin film transistor are p-type transistors.

5. The method of claim 4, wherein the black display voltage is a high level voltage and the video data voltage is a low level voltage.

6. The method of claim 4, wherein the second voltage supply line is grounded.

7. The method of claim 1, wherein a) and b) are simultaneously performed.

8. The method of claim 7, wherein c) and d) are simultaneously performed.

9. A driving method for a display device, the display device comprising a scan line, a data line, a first voltage supply line, a switching thin film transistor connected to the scan and data lines, a driving thin film transistor connected to the switching thin film transistor and the first voltage supply line, and a light emitter connected to the driving thin film transistor and a second voltage supply line, the method comprising:

limiting the transistors contained in each pixel to the driving thin film transistor and the switching thin film transistor;

turning the light emitter on and off without altering a voltage applied to a cathode electrode of the light emitter;

a) applying a black display voltage to the data line;

b) applying a first gate ON signal to the scan line to supply the black display voltage to the driving thin film transistor;

c) applying a video data voltage to the data line; and d) applying a second gate ON signal to the scan line to supply the video data voltage to the driving thin film transistor.

10. The method of claim 9, wherein a storage capacitor is connected between the switching thin film transistor and the first voltage supply line.

11. The method of claim 9, wherein the switching thin film transistor and the driving thin film transistor have channels with the same doping type.

12. The method of claim 9, wherein the second voltage supply line is grounded.

13. The method of claim 9, wherein a), b), c) and d) are performed at least once each frame.

14. The method of claim 13, wherein an input time of the video data voltage increases at a rate of $2^A$, where A is a positive integer including zero and is the number of times a), b), c) and d) are repeated in a particular frame.

15. The method of claim 9, wherein at least one of: a) and b) are simultaneously performed or c) and d) are simultaneously performed.

16. The method of claim 9, wherein the light emitter is a light-emitting diode.

17. The method of claim 16, wherein the light-emitting diode is an organic light-emitting diode.

* * * * *